United States Patent [19]

Rich

[11] Patent Number: 4,551,576

[45] Date of Patent: Nov. 5, 1985

[54] FLAT EMBEDDED-SHIELD MULTICONDUCTOR SIGNAL TRANSMISSION CABLE, METHOD OF MANUFACTURE AND METHOD OF STRIPPING

[75] Inventor: Donald S. Rich, Long Valley, N.J.

[73] Assignee: Parlex Corporation, Methuen, Mass.

[21] Appl. No.: 596,534

[22] Filed: Apr. 4, 1984

[51] Int. Cl.[4] ..... H01B 7/08; H01B 11/00

[52] U.S. Cl. ..... 174/36; 174/117 F; 174/117 FF

[58] Field of Search ..... 174/36, 117 F, 117 FF

[56] References Cited

U.S. PATENT DOCUMENTS

| | | | |
|---|---|---|---|
| 3,168,617 | 2/1965 | Richter | 174/117 FF |
| 3,391,246 | 7/1968 | Freeman et al. | 174/117 FF |
| 3,612,744 | 10/1971 | Thomas | 174/36 |
| 3,634,782 | 1/1972 | Marshall | 174/36 X |
| 3,663,739 | 5/1972 | Chevrier | 174/117 F X |
| 3,703,604 | 11/1972 | Henschen et al. | 174/36 X |
| 3,764,727 | 10/1973 | Balde | 174/117 FF X |
| 3,775,552 | 11/1973 | Schumacher | 174/36 X |
| 3,917,900 | 11/1975 | Arnaudin, Jr. | 174/36 X |
| 4,149,026 | 4/1979 | Fritz et al. | 174/117 F X |
| 4,155,613 | 5/1979 | Brandeau | 174/36 X |
| 4,218,581 | 8/1980 | Suzuki | 174/117 FF X |
| 4,287,385 | 9/1981 | Dombrowsky | 174/117 F X |
| 4,297,522 | 10/1981 | Jesse et al. | 174/36 |
| 4,381,420 | 4/1983 | Elliott et al. | 174/36 X |
| 4,404,424 | 9/1983 | King et al. | 174/36 X |

FOREIGN PATENT DOCUMENTS

| | | | |
|---|---|---|---|
| 2644252 | 3/1978 | Fed. Rep. of Germany | 174/117 F |
| 1558962 | 1/1980 | United Kingdom | 174/36 |

*Primary Examiner*—A. T. Grimley

*Assistant Examiner*—Morris H. Nimmo

*Attorney, Agent, or Firm*—Weingarten, Schurgin Gagnebin & Hayes

[57] ABSTRACT

A flat embedded-shield multiconductor signal transmission cable includes an embedded conformal shield interposed between adjacent conductors to significantly reduce cross-talk by as much as several orders of magnitude over conventional techniques. The shield is forced to a shape in which it is interposed between adjacent conductors by pinch rolling a sandwich of the conductors, insulation and shield between heated rollers, in which the top and bottom sets of conductors are forced inwardly to lie one beside the other with the shield in between. Uniform termination impedance is achieved because the embedded shield is protected during cable stripping. In an alternative embodiment, external shielding may be utilized to completely circumferentially surround the conductors. For improved pitch control, both heated pinch rollers are identical and are provided with resilient surfaces. Additionally, improvement in pitch control is obtained through the use of cylindrical wire guides in which the wires are pulled over cylindrical surfaces and then over a portion of the cylindrical heated pinch roller prior to pinch rolling, with the wires being preheated prior to arriving at the nip of the pinch rollers. This permits added dwell time for preheating of the wires and therefore greater peel strength and dimensional stability. Alternatively, pitch control is achieved through the utilization of a wire guide having a floor portion which is slanted towards one edge or the other of the guide such that when the wires are pulled downwardly through the guide, they move toward the wire guide edge having the lower portion of the sloped floor adjacent thereto.

17 Claims, 21 Drawing Figures

10
12
12'
14
16
18
20
20'
22
22'
24
26
28
30
34
36
38
40

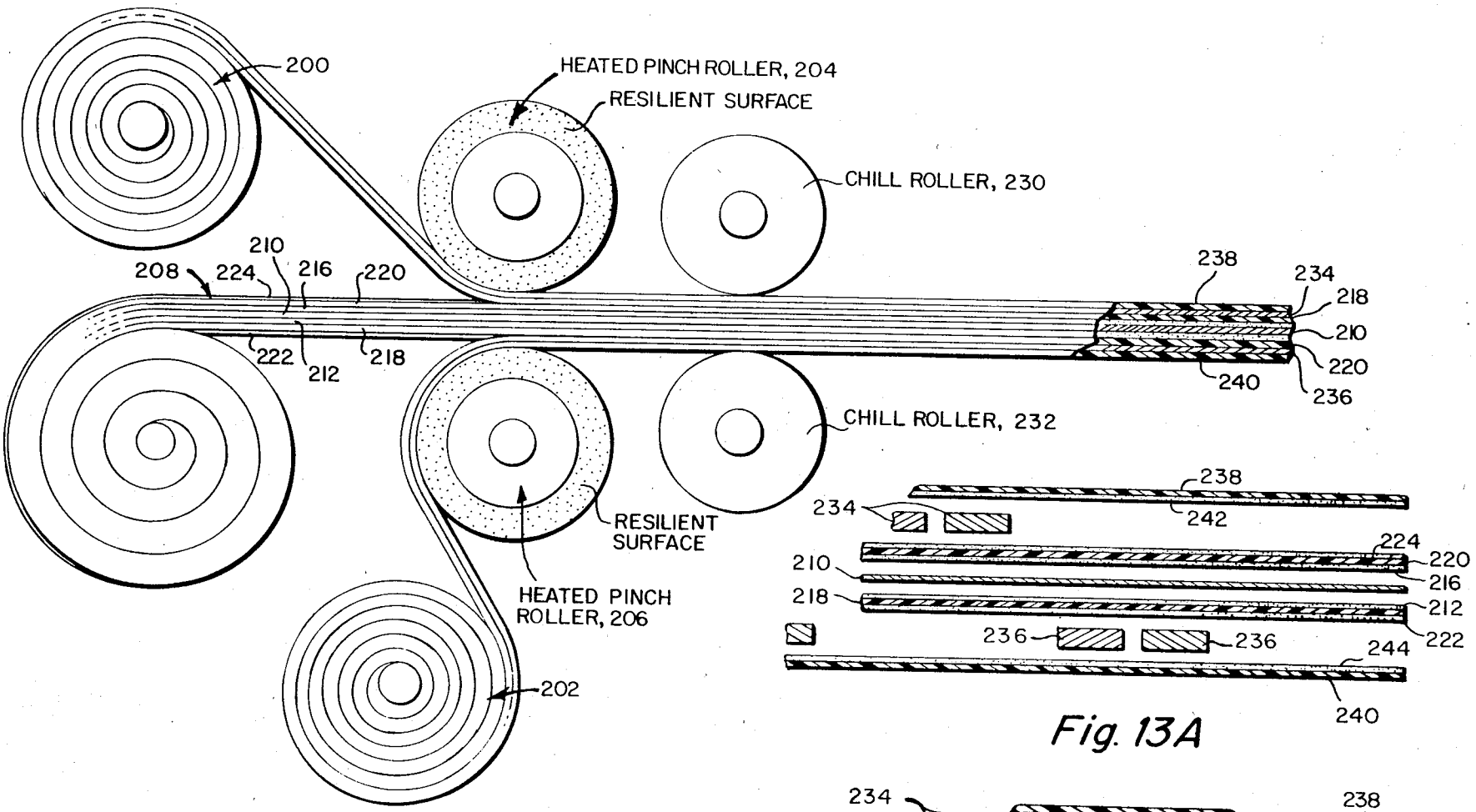
Fig. 12
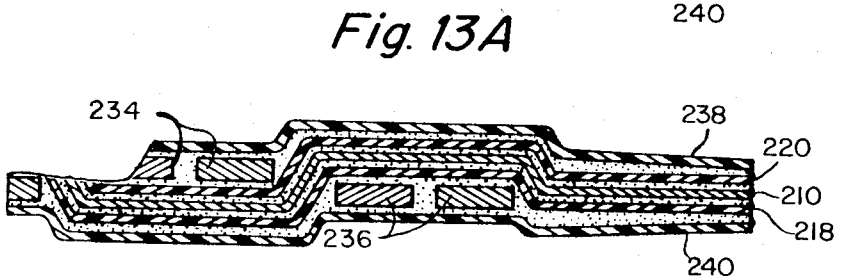
Fig. 13A
Fig. 13B

FLAT EMBEDDED-SHIELD MULTICONDUCTOR SIGNAL TRANSMISSION CABLE, METHOD OF MANUFACTURE AND METHOD OF STRIPPING

FIELD OF INVENTION

This invention relates to electrical cables and more particularly to a flat multiconductor cable system, its method of manufacture and method of stripping.

BACKGROUND OF THE INVENTION

Proliferating data and communication signal transmission needs have stimulated the development of multiconductor cables of both extruded and/or laminated constructions. Their application, although as diverse as data bus intra-computer cabinet wiring, peripheral interconnects and under carpet voice and data wiring, share in common problems of cross-talk, signal distortion, attenuation, termination, electromagnetic compatibility and minimum physical size. To meet these parameters, multiconductor cables have been produced by controlling impedance uniformity and encasing them within suitable shields.

One predominant problem is the control of cross-talk within a cable. Cross-talk refers to a phenomenom in which signals are transmitted from an active line to a passive line via electrostatic and electromagnetic fields. Cross-talk and, more particularly, near-end cross-talk is the result of adjacent fields interacting with each other which is usually measured by providing one active pair of conductors or wires which carries a signal, and a passive pair of conductors positioned adjacent the active pair of conductors, with the degree of cross-talk being measured as the degree of signal pickup on the passive pair. Typically, the cross-talk signal level on the passive pair ranges from 10 dB to 100 dB lower than the signal in the active pair. It is this signal pickup which is the result of electrostatic and/or inductive coupling. It will be appreciated that in this patent the terms "wires" and "conductors" are used interchangeably.

Three techniques are commonly used to achieve cross-talk control. The first is referred to as a "ground plane" construction in which a solid or perforated ground plane is placed in intimate proximity to signal conductors to decouple them. The second approach relies on an interposed conductor, referred to as a ground-signal-ground (GSG) system or its paired variant, the ground-signal-signal-ground (GSSG) system to drain off interfering fields. Still a third technique relies on geometric decoupling to preserve the integrity of signal transmission. However, none of these techniques have adequately solved the problem of cross-talk without undesirable tradeoffs.

In the case of GSG construction, the tradeoff is excessive physical bulk in which only one third of the conductors are carrying intelligence, with the other two thirds being ground returns. This results in an excessively wide cable and the need for expensive high conductor count cables.

Ground plane cables are only partially effective in controlling cross-talk, and generally lead to low impedance constructions that can be difficult to drive. Their major other drawback is that they frequently require stripping of the ground plane to terminate the conductors which can lead to an impedance discontinuity at its terminating connection. When the ground plane element itself is cut or abraded the distance varies between it and the conductors from which it is insulated, causing the impedance discontinuity. More importantly with respect to conventional ground plane cables, the grounding or shielding element is planar and therefore does not provide circumferential protection about the individual conductors. Thus, while some signal decoupling is accomplished by the conventional ground plane configuration, substantial leakage occurs between conductors which are adjacent one another such that substantial cross-talk persists.

Geometrically decoupled cables such as illustrated in U.S. Pat. No. 4,381,420 can achieve low cross-talk. However, these cables are extremely dependent on critical spatial relationships of their multiconductors, and as a result are difficult to manufacture within critical tolerances. Part of the problem associated with the process described in this patent is that, while pinch rolling is used, only one of the pinch rollers has a resilient surface, with one or both having preformed grooves therein. The tolerance problem aside, conductors are overlapped on opposite sides of a dielectric, making termination a labor intensive operation. Moreover, in the above-mentioned patent, there is no shielding provided to eliminate cross-talk.

By way of further background, the general nature of a ground plane conductor is an array of individual conductors in one plane, some dielectric medium interposed between the array and the ground plane material itself. The general theory associated with cross-talk reduction by the utilization of a conventional ground plane is that the immediate field surrounding the active conductors will be shunted to the ground plane and to ground, thereby diminishing its effect on adjacent conductors as a result of a capactive coupling. However, in between the adjacent conductors there is no electrostatic shield such that the signals which have only partially coupled to the ground plane are also coupled between adjacent conductors which results in cross-talk. While the conventional ground plane cable assists in draining off some of the spurious electrostatic field, a major part of it is nonetheless present.

U.S. Pat. Nos. 3,312,870; 3,757,029; 3,703,604; 3,818,117; 4,045,750; and 4,340,771 illustrate various ground plane or slotted ground plane configurations. In each case the ground plane in no way is interposed between adjacent conductors.

U.S. Pat. Nos. 3,763,306; 4,143,236; and 4,218,581 illustrate the ground-signal-ground or ground-signal-signal-ground type cross-talk prevention systems. It should be noted that with respect to the last mentioned patent, this is a typical ground-signal-ground configuration in which the conductors are always to one side of the ground plane. Moreover, it will be appreciated that there is no circumferential shield with respect to the signal conductors, with the only member between signal conductors being another conductor which is in contact with the ground plane. The last mentioned conductor is not conformal in that it does not wrap around the signal conductor but simply takes up a little bit of space and provides a small amount of shielding effectiveness.

With respect to the formation of flat cable and referring again to the above-mentioned U.S. Pat. No. 4,381,420, it is very important to note that in order for registration to take place in the above-mentioned patent, the pinch rollers must have grooves in them in order to provide for the conformal nature of the insulating material and the precise conductor spacing. It should be noted that in this patent there is no internal shield whatsoever. The registration of the top and bottom conductors in this patent is extremely critical and must be on the order of ±0.002 inches in order for geometric cross-talk control to be effective. Such pitch control is rarely if ever achieved in production with the grooved rollers specified in this patent. The result is that tremendous tolerance problems are encountered when attempting to manufacture a flat cross-talk inhibited cable in accordance with this patent.

By way of further background, U.S. Pat. No. 3,391,246 illustrates a general laminating process for providing ground plane flat multiconductor cables. U.S. Pat. No. 3,168,617, as well as French Pat. No. 1,175,923, also illustrate laminating processes for providing multiconductor flat power cable for wallpaper.

With respect to termination and stripping of prior art cables, reference is made to U.S. Pat. No. 3,547,718 which illustrates stripping of a central portion of the cable to expose the conductors. However, nowhere in this patent is a ground plane or other cross-talk inhibition utilized. Additionally, U.S. Pat. No. 3,522,652 illustrates the stripping away of the top layer of a flat cable to provide an end termination therefor.

It will be noted that U.S. Pat. Nos. 3,413,405; 4,283,593 and 4,297,522 illustrate flat cables with exterior shielding as opposed to interior shielding. U.S. Pat. No. 4,155,613 illustrates the encapsulation of parallel wires surrounded by a plastic jacket for use as a very thin flat telephone cable. This patent graphically illustrates the pitch of the cable as the distance from the center of one conductor pair to the center of another conductor pair. Typically, the term "pitch" refers to the spacing between conductor pairs and in general for many typical telephone systems the pitch is on the order of 0.0425 inches.

Finally, U.S. Pat. Nos. 3,079,458; 3,090,825; 4,149,026; 4,154,977; 4,165,559; 4,258,974; and 4,287,385, as well as British Pat. No. 1,198,739 illustrate various electrical flat cable configurations.

SUMMARY OF THE INVENTION

Shielding

A flat embedded-shield multiconductor signal transmission cable either for balanced or unbalanced lines includes an embedded electrically conductive shield between opposing interdigitated offset conductors in which the shield is interposed between adjacent conductors such that in a conformal embodiment semi-circumferential shielding significantly reduces cross-talk by at least an order of magnitude over conventional flat ground plane shielded systems and multiconductor cables including ground-signal-ground configurations; and provides at least as good cross-talk protection as properly constructed geometric decoupled cables. The shield may be floating, may include a drain wire which is grounded, may be split to provide independent ground returns for isolated grounds, or may be used with either paired or individual conductors. The shield in the usual embodiment stops short of the longitudinal cable edges or may occupy only a portion of the width of the cable. The conformal shield is forced to a shape which interposes it between adjacent conductors by pinch rolling a sandwich of the conductors, insulation, shield, and a dielectric heat-activated adhesive between heated pinch rollers, with the heat activated adhesive carried by various carrier strips to bond the structure together.

As will be appreciated, the shield may be made of an electrically conductive material which in foil form is approximately one mil thick, although the thickness of the shield is noncritical. Also the shield may be woven, or apertured.

In one embodiment, the shield material takes on a serpentine path when the sandwich structure is laminated through heated pinch rollers having resilient surfaces such that the shield does not remain flat, as in a ground plane configuration, but rather is a conformal shield embedded in the cable. It will be seen that the shield crosses several planes making it inappropriate to characterize the shield as a ground plane in this embodiment. In another embodiment the shield is relatively flat, but with selected adjacent conductors positioned to either side of the shield and laterally offset one from the other. This is the case when only light lamination pressure is used. In either case, the individual adjacent conductors are separated by a Faraday electrostatic shield so that stray electrostatic fields or unwanted fields which create cross-talk are significantly reduced. If the shield material is nonmagnetic, for instance copper, while eliminating electrostatic effects, it does not shield inductively induced fields. However, the shield can be formed out of nickel or other magnetic alloys which provides both electrostatic and inductive or electromagnetic shielding. In either event, the shield, whether conformal or not, forms a semi-circumferential envelope between active signal carrying conductors.

Top and bottom shielding can be provided, which construction permits complete elimination of external influences operating on the cable. For most applications it is not important to have an external shield. For example, in telecommunications, and telephone in particular, stray fields have an insignificant effect on telephone conversations because of the relatively low freqeuncy character of telephone conversations. Thus, the transmission of phone conversations through an unshielded wire does not radiate significant amounts of energy into the electromagnetic surround because of its low frequency signalling. With respect to high speed transmission cable, the embedded internal conformal shield is extremely effective regardless of the signal rate of transmission and, in fact, is important to eliminate the high frequency effects of cross-talk. However, for further protection an external shield may be provided. Thus, if in addition to cross-talk other types of electromagnetic interference (EMI) are involved, it is entirely within the scope of this invention to enclose the entire cable with external shielding to shield the cable against externally generated noise or spurious radiations. This would in effect produce a near-perfect cable medium.

In summary, the subject configuration offers orders of magnitude increased cross-talk protection due to the semi-circumferential shielding, regardless of whether an external shield is used or not. Moreover, cross-talk elimination is not dependent on the critical spacings or geometric configurations and therefore requires no high tolerance techniques such as those described above in U.S. Pat. No. 4,381,420 in which pinch rollers are provided with grooves. Because no GSG or GSSG system is used, the subject cable is characterized as a high density/minimum physical size cable, in which the smaller size for a given pitch results in a two thirds reduction in size over ground-signal-ground type configurations.

Note, this system may be utilized for balanced or unbalanced transmission lines.

Termination

Uniform termination impedance is achieved because the positions of the conductors relative to the shield are not disturbed during an abrading-stripping operation such that the protected inner structure is not disturbed when the cable is stripped for termination. In one embodiment, termination entails the grinding off of the topmost and bottommost outer dielectric layers which form the skin of the cable to expose the conductor ends. The present cable is easily stripped because there is no molecular bond between the skin and the array. The stripping is done by conventional grinding in which the spacing between the conductors and the shield is unchanged during the termination process, resulting in uniform termination impedances. Additionally, when thick cross-section conductors are utilized, a termination procedure can be used which results in grinding of the conductors and intermediate material down to the shield without completely grinding through the conductors. Thus, connection can be made to the shield itself without deleterious effect to the shield or adjacent conductors. As will be discussed, the use of thick conductors aids both in the ability to hold pitch and in the termination process because the thick conductors swim less and are therefore precisely located. However, as will be seen, utilizing the subject processes, thin conductors may be used to obtain the improved pitch control made possible by the manufacturing techniques described herein. In a further embodiment, a second grinding step immediately over the shield area, exposes the shield for connection without the necessity of using thick conductors.

Manufacturing

In one embodiment, preformed cable halves with an insulated shield sandwiched in between are introduced to the nips of the heated rollers. In this embodiment, the conductors are prelaminated onto dielectric carrier sheets. In an alternative process, the cable is made in a single pass in which all constituent parts are married as they are fed into the heated pinch rollers.

In the pinch rolling process, in one embodiment, the pinch rollers have identical diameters and are both provided with resilient ungrooved surfaces which offer substantial improvement in pitch regulation due to the top and bottom symmetry of the conformal cable produced. In this process the top and bottom sets of laterally offset conductors are forced inwardly, which forces the shield in between adjacent conductors to form a conformal cable with symmetry existing on both sides, unlike the single-sided symmetry when only one pinch roller has a resilient surface. The symmetry is in major part due to the use of identical heated pinch rollers, with both rollers being coated with a soft compliant material. The result is unusually good, unexpected pitch control, e.g. uniform accurately controlled conductor spacing.

As will be discussed, excellent pitch control is also achieved by using cylindrical wire guides and introducing the guided conductor or wire tangentially to the pinch roller surface above the nip with a minimal or substantially zero transfer gap, such that the wires travel with the pinch roller surface for a small distance prior to arriving at the nip. The travel over the pinch roll both maintains wire position and preheats the wire for better bonding, less conductor swimming and increased peel strength. In this embodiment, cylindrical guides with cylindrical grooves are used to position the conductors, with the high accuracy being in part due to the cylindrical grooves in the cylindrical guide over which the conductors are drawn; the tangential introduction of the wires to the cylindrical surfaces of the pinch rollers over which the conductors are drawn prior to lamination; and the substantially zero transfer gap between the guide and the nip of the pinch rolls due to the tangential introduction of the conductors onto the pinch roll surfaces. This process provides for pitch control similar if not better than that required in abovementioned U.S. Pat. No. 4,381,420 for geometric crosstalk control. Note that pitch control by use of cylindrical guides is due to the fact that any web pulled over a cylindrical surface will align itself perpendicular to the axis of the cylinder. These pitch maintaining techniques are also useful in manufacturing shieldless cable, and as such are part of the subject invention.

More particularly, in both the single and double pass processes, conductors are formed onto dielectric carrier sheets in between which is sandwiched the shield which is located between single or double adhesive coated dielectric carrier sheets. Heat activated adhesive layers in the form of polyester coatings are utilized between all members of the sandwich such that when the sandwich is presented to heated pinch rollers, the adhesive melts. In the pinch rolling process, the internal shield is forced between the offset opposed conductors and after chill rolling the adhesive sets and a mechanically stable cable is formed.

In one of the processes described, it is a two pass process, with the first pass providing top and bottom arrays of copper on MYLAR. In the second pass, the shielding material sandwiched between two MYLAR insulating carrier sheets is interposed between the top and bottom arrays and the entire sandwich is laminated. The offset of the arrays of conductors on the top and bottom is achieved by guiding the two webs and adjusting them until they achieve the proper spatial relationship between opposed sets of conductors.

In several other embodiments, marrying of all the above constituent parts is done simultaneously in one pass, with the final sandwich being fabricated with only one pair of heated pinch rollers.

In one embodiment, the copper conductor has a cross-sectional dimension of 7 mils by 28 mils which, due to their offset interdigitation forces the 1 mil foil, to be deformed between the interdigitated conductors.

In another embodiment, the conductors measure 7 mils thick by 28 mils wide. This is equivalent to 26 gauge wire with a length-to-width aspect ratio of 4, a fairly low number for flat conductor cable. With relatively thick copper conductors and the aforementioned wire guide, accuracy in conductor placement is achieved which allows the conductors to be put down on a very close pitch. This in turn results in a narrower cable structure, which aside from being less expensive due to less insulating material being used, results in a higher density cable construction. With an aspect ratio of 4, it is possible to produce a cable on very close pitch centers with a minimum of MYLAR. In this case, the pitch in one embodiment is 0.0425 inches, which corresponds to a frequently used standard in the telephone industry. The spacing between the edges of the conductors is therefore the difference between 0.0425 inches and 0.028 inches or approximately 0.014 inches. When wires are put down on a close pitch, a ±0.002 inch variation can lead to significant variations in pitch. However, by either tapering the floor of the wire guide, or by using the grooved cylindrical guide and pinch roller, better than ±0.002 inches tolerance can be achieved, especially with thick conductors.

SUMMARY

In summary, the above-noted construction results in a shield that is interposed between adjacent conductors for maximum cross-talk elimination and in one embodiment is serpentine and conformal. These conductors can either be paired or individual conductors, with the shield, insulated on both sides, finding its way physically between the two conductors due to the pinch rolling of the laminated sandwich structure. This in effect results in the equivalent of a Faraday cage kind of construction in which the electrostatic field is close to zero between adjacent conductors. While the electrostatic field is not completely zero because there are leakage paths that do exist, compared to a conventional ground plane cable, the result is orders of magnitude improvement in cross-talk control. Moreover, pitch control is markedly enhanced by the use of resiliently-surfaced pinch rollers and cylindrical wire guiding means which includes a grooved cylindrical guide tangentially feeding the wire to the surface of the adjacent heated pinch roller ahead of the nip.

BRIEF DESCRIPTION OF THE DRAWINGS

These and other features of the subject invention will be better understood in conjunction with the detailed description taken in conjunction with the figures of which:

FIG. 12 is a diagrammatic and partial cross-sectional illustration of the production of a finished cable in which preformed cable halves produced in accordance with the method described in connection with FIG. 10 are utilized to either side of a shield sandwiched between double-coated insulating layers;

FIG. 13A is an exploded view of the structure formed in the process illustrated in FIG. 12 illustrating a central shield sandwiched in between double-coated insulating carrier layers, with interdigitated conductors to either side of these double coated carrier layers, followed by an outer skin which includes adhesive-coated insulating layers;

FIG. 13B is a cross-sectional illustration of the structure formed when the structure of FIG. 13A is pressed together between pinch rollers, indicating the semi-circumferential shielding of the conductor pairs;

DETAILED DESCRIPTION OF THE INVENTION

Figures 1A, 1B, 2:
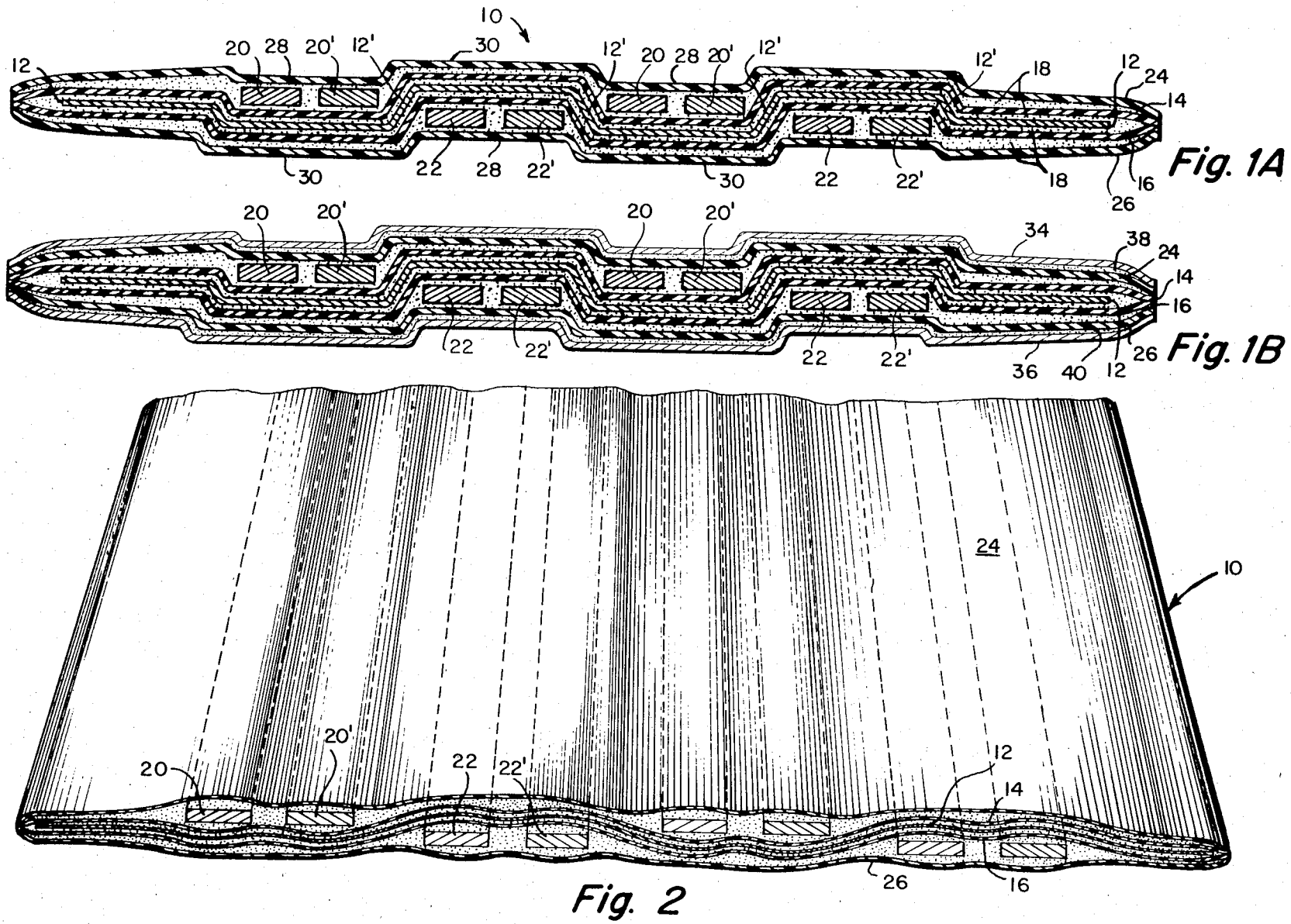
FIG. 1A is a cross-sectional illustration of the subject flat embedded shield muliconductor signal transmission cable showing interleaved offset conductors with the shield interposed between adjacent conductor pairs to significantly reduce cross-talk by forming a semi-circumferential shield around the pairs of conductors.
FIG. 1B is a cross-sectional illustration of the flat embedded shield multiconductor signal cable of FIG. 1A illustrating an exterior shield to provide a full circumferential shielding between pairs of conductors.
FIG. 2 is a diagrammatic and cross-sectional illustration of the multiconductor flat cable of FIG. 1A illustrating the conformality of the shield and exterior layers, along with the interdigitation of the pairs of conductors by virtue of a process in which a sandwich of the conductors is passed through heated pinch rolls with resilient surfaces.

Referring now to FIG. 1A, a diagrammatic or schematic illustration shows a flat embedded shield multiconductor signal transmission cable 10 including a serpentine inner shield 12 of copper, nickel or other material depending on whether or not electrostatic and/or magnetic properties are desired. Serpentine shield 12 is sandwiched between dielectric insulating layers 14 and 16, with layers 14 and 16, in one embodiment, being provided with dielectric heat-activated adhesive layers 18 on either side thereof.

The cable includes pairs of conductors or wires 20, 20' and 22, 22', which are disposed in between dielectric layers 14 and 24; and 16 and 26, respectively. Adhesive 18 occupies the space between dielectric layers 14 and 16 and respective outer protective layers 24 and 26 which form the outer skin of the cable. In one embodiment, the above-mentioned layers are made of MYLAR, and the heat activated adhesive is a polyester material.

It will be appreciated that the entire structure is conformal in that there is a depressed area adjacent the conductor pair, whereas there is a corresponding bulge 30 on a diametrically opposite of the cable as illustrated. As a result of the lamination, pairs 20, 20' are interleaved with pairs 22, 22', with shield 12 being interposed at positions 12' between adjacent pairs of conductors. As can be seen the shield is not a flat ground plane shield, but rather semi-circumferentially encloses the respective conductor pairs, thereby to produce a Faraday cage-like shield between the conductor pairs. As mentioned hereinbefore, this is considerably more effective in eliminating cross-talk between the pairs such that an extremely thin, narrow cable can be produced with interdigitated pairs having either a floating shield or grounded shield therebetween. Preliminary tests indicate an order of magnitude improvement in cross-talk rejection over flat ground plane cables.

Referring to FIG. 1B, the structure of FIG. 1A has been provided with an outer shield 34 and 36 which is attached adhesively by layers 38 and 40 and outer layers 24 and 26, respectively. It will be appreciated that the shape of the outer shield in general conforms to that of the skin of the cable of FIG. 1A, and as such does not disturb the serpentine semi-circumferential shielding afforded because of the interposition of shield 12 between adjacent interdigitated pairs of conductors. The purpose of the optional exterior shield is to provide full circumferential shielding.

Referring to FIG. 2, an as-manufactured portion of the cable of FIG. 1A is shown diagrammatically to illustrate the conformal or nonflat nature of the outer surfaces of the cable which in general are caused by the thicknesses of the pairs of conductors 20, 20' and 22, 22'. FIG. 2 illustrates the result of having processed the sandwich of all the constituent parts of the cable through heated pinch rollers in which the adhesive is melted, in one embodiment, at 320° F. to form a uniform adhesive binder for the dielectric and electrically conductive members of the sandwich. In one embodiment, layers 14 and 16 are double coated with polyester, whereas outer layers 24 and 26 are single coated with polyester on their interior surfaces. As can be seen from this diagram, the shield is in fact deformed during the hot pressing process so that it is in fact interposed between adjacent pairs of conductors or wires within cable 10.

Figure 3:
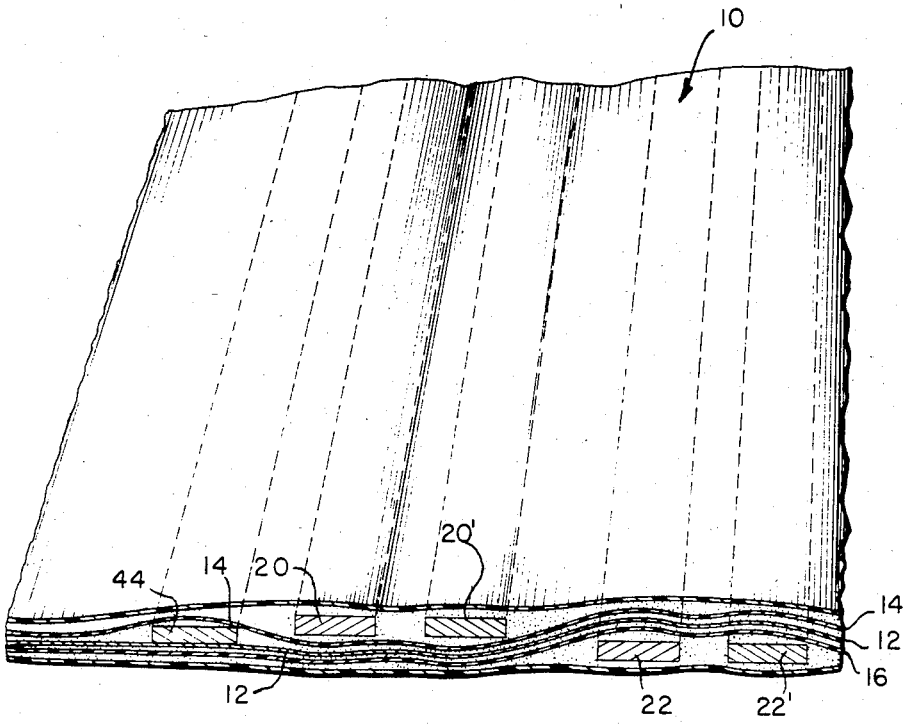
FIG. 3 is a diagrammatic and cross-sectional illustration of a flat embedded shield multiconductor signal transmission cable illustrating an internal ground wire electrically connected to the internal shield.

Referring to FIG. 3, cable 10 may be provided with a ground return 44 which is electrically connected to and lies on top of shield 12, with dielectric layer 14 running over top of conductor 44. In this diagram, like elements of FIGS. 1, 2 and 3 carry like reference characters.

Figure 4:
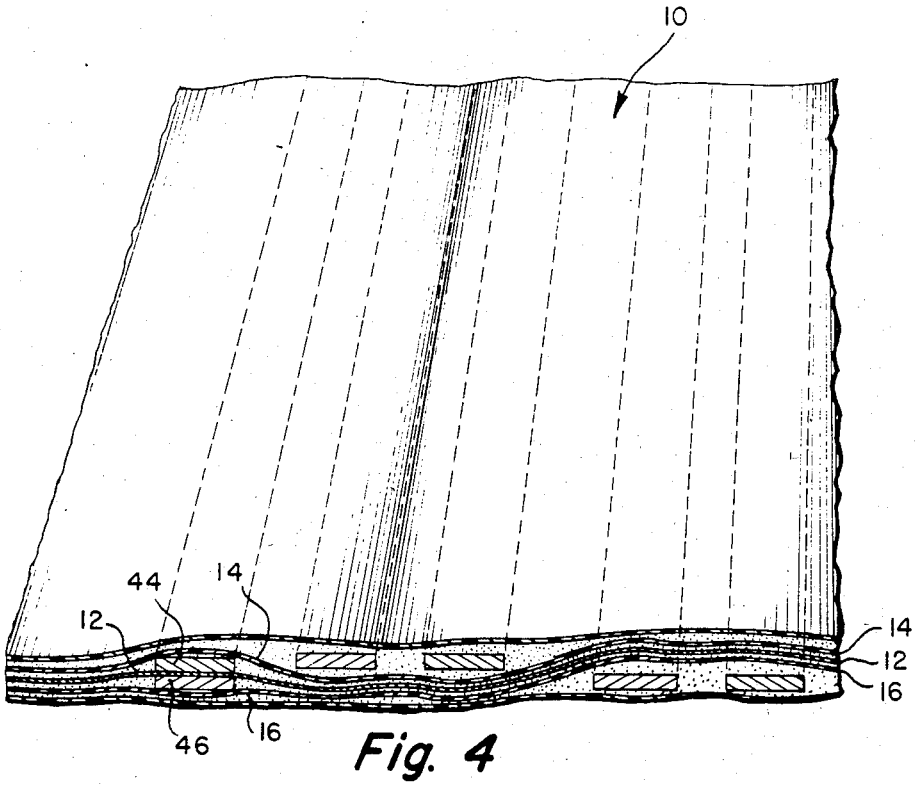
FIG. 4 is a diagrammatic and cross-sectional illustration of a flat embedded shield multiconductor signal transmission cable utilizing a double ground wire positioned to either side of the internal shield.

Referring to FIG. 4, a second ground return 46 is added opposite ground return 44 to provide for double the current-handling capacity for the ground return. In this case, ground return 46 is electrically connected to shield 12 and has dielectric layer 16 running over top of it, as illustrated.

Figure 5:
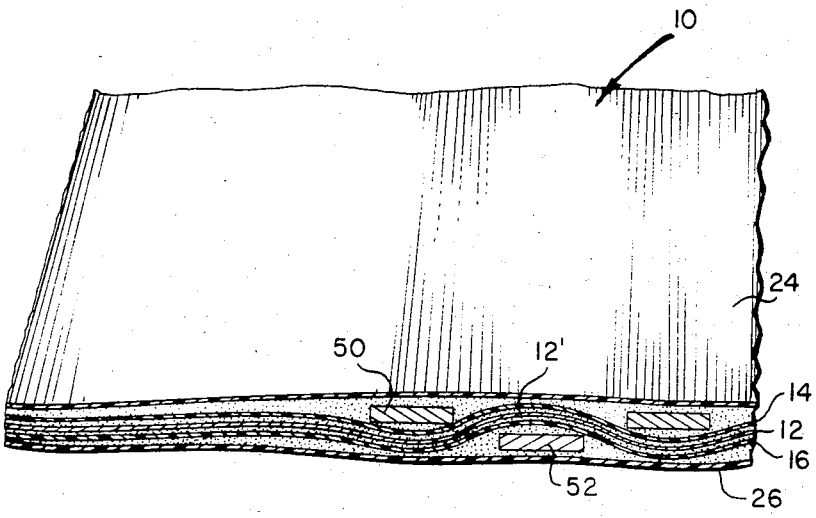
FIG. 5 is a diagrammatic and cross-sectional illustration of a flat embedded shield multiconductor signal transmission cable illustrating the shielding between individual adjacent conductors.

While up to the present point cables having paired conductors have been described, it is of course possible, with the subject technique, to isolate individual interdigitated single conductors one from the other through the utilization of the serpentine shield 12 of FIGS. 1–4. As illustrated in FIG. 5, shield 12 is positioned between individual conductors 50 and 52 as illustrated at 12', again with shield 12 having dielectric layers 14 and 16 to either side thereof and adhesively attached not only to the shield but also to the adhesive which joins outer layers 24 and 26.

Figure 6:
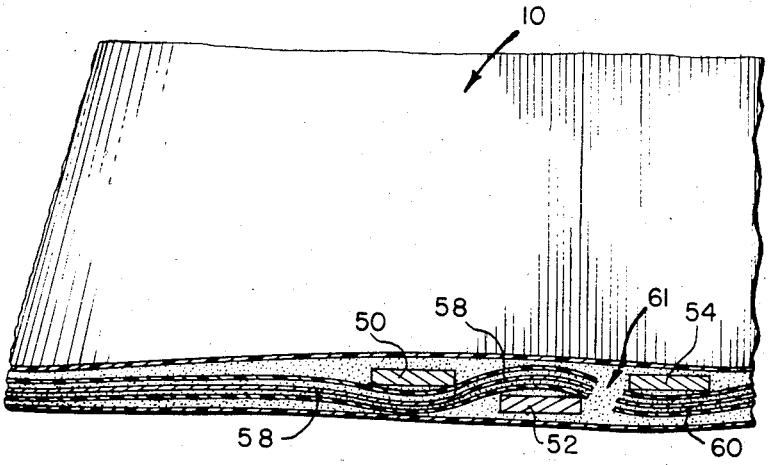
FIG. 6 is a diagrammatic and cross-sectional illustration of a flat embedded shield multiconductor signal transmission cable illustrating the severing of the internal shield into two halves along the longitudinal axis of the cable for providing independent ground return paths for isolated grounds.

The same configuration as illustrated in FIG. 5 may be provided with a split shield here illustrated in FIG. 6 at 58 and 60. In this embodiment, conductors 50 and 52 are separated by shield 58 at 58', whereas conductor 54 and its associated shield 60 is isolated from other conductors, and shield at a longitudinal split 61. The purpose of the longitudinal split is to provide an independent ground return path for isolated grounds for various sections of the cable, making the subject cable uniquely suited to a large variety of applications.

In one embodiment, the dielectric insulating layers and the outer layers are all made of MYLAR, with the inner insulating layers being double coated with a heat activated layer such as polyester. It will be appreciated that the polyester adhesive melts at approximately 320° F., whereas MYLAR degrades at approximately 400° F. Alternative materials for the carriers and skins include polyethylene, Teflon, vinyl and Nomex, or combinations thereof, whereas the adhesives can be either thermally or pressure activated.

In an alternative embodiment, all adhesive may be removed, assuming that the sandwich is press rolled between pinch rollers that are maintained above the fusion temperature of the carrier and skin, in this case 350° F. However, the utilization of layers of adhesive which when melted run together create an exceptionally durable mechanically-stable cable in which the pitch of the cable is maintained throughout its length. In short, the utilization of the intermediate adhesives which are melted and run together upon pinch rolling provides for a cable in which the impedance variations are slight and in which pitch control is uniquely stabilized.

Stripping

Figure 7:
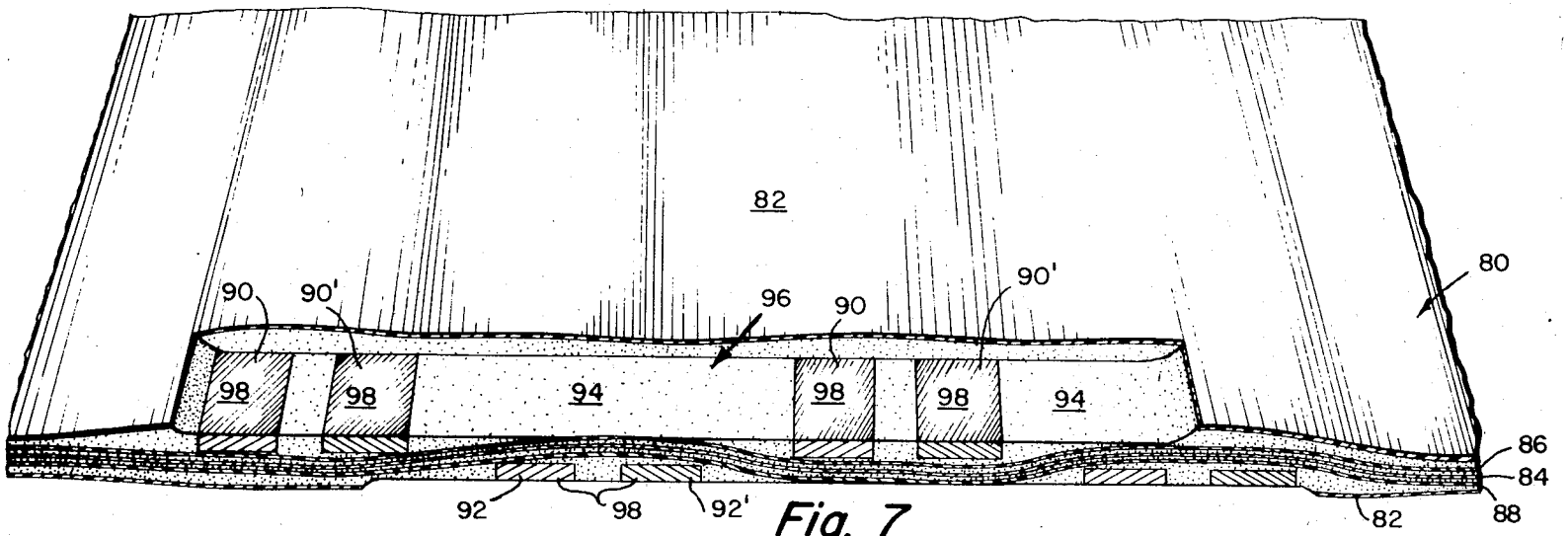
FIG. 7 is a diagrammatic and cross-sectional illustration of the stripping of the end of the multiconductor signal cable of FIGS. 1 and 2 for a floating shield embodiment through a grinding or abrading operation which exposes the top portions of the conductor pairs but does not extend down to the embedded shield.

It is a feature of the subject invention that the termination of the subject cable preserves the impedance of the cable because the relative spacing of the shield and the conductors is maintained during the stripping process. Referring now to FIG. 7, a cable 80 having an outer layer 82 and an embedded shield 84 surrounded by insulating layers 86 and 88 has conductor pairs 90, 90' running therethrough, with an interdigitated pair 92, 92' interspersed between the adjacent conductor pairs 90, 90'. The adhesive binding the structure together is generally indicated at 94.

In order to obtain connection to the conductors, the top and bottom layers 82 are abraded down as illustrated in the area 96 to expose top surfaces 98 of conductors 90, 90' and conductors 92, 92'. In this embodiment, shield 84 is a floating shield which is useful in a wide variety of applications.

Should conductors 90, 90' and 90, 92' be of sufficient thickness, then the grinding down operation illustrated in FIG. 7 may be continued so as to expose top surface 100 of shield 84 having ground through dielectric layer 86 at the points illustrated at 86'. This exposes not only the ground-down portions of conductors 90, 90' and 92, 92' but, with the identical grinding operation carefully controlled, the shield can be exposed for purposes of connection thereto.

Figure 8:
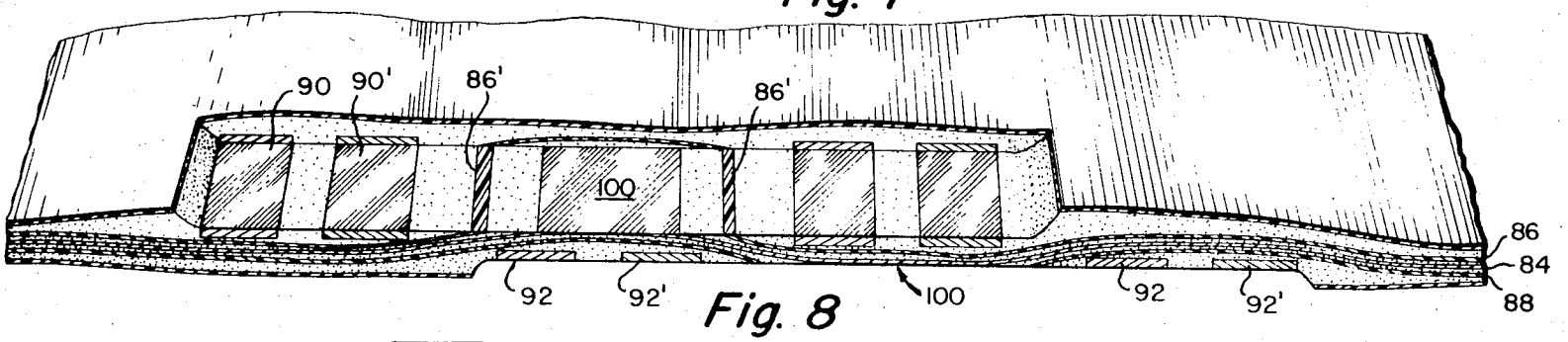
FIG. 8 is a diagrammatic and cross-sectional illustration of the multiconductor flat embedded shield cable of FIG. 7 in which relatively thick conductors are used and in which the embedded shield is exposed via a second grinding operation which also grinds down and removes a portion of the adjacent conductors.
Figure 9:
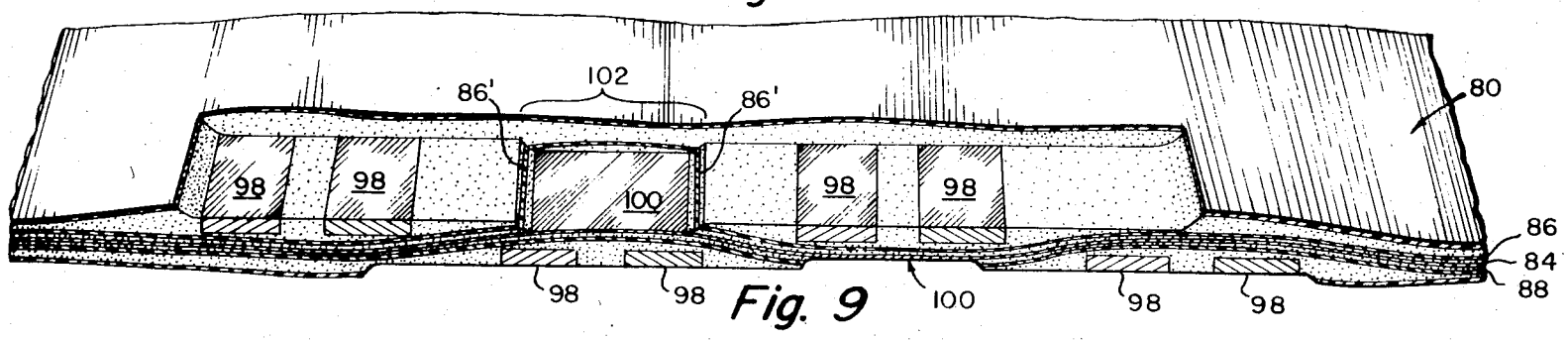
FIG. 9 is a diagrammatic and cross-sectional illustration of the flat embedded shield multiconductor signal transmission cable of FIG. 7 illustrating a second grinding operation to expose the shield without abrading away adjacent conductors.

Referring to FIG. 9 in an alternative embodiment, after the first grinding/stripping operation illustrated in FIG. 7 exposes conductors 90, 90' and 92, 92' at surfaces 98, a further grinding operation generally indicated in the area of 102 exposes surface 100 of shield 84, thereby to permit electrical connection to the shield without the need for thick conductors. In this manner, dieletric layer 86 is ground through as illustrated at 86' to expose the underlying shield surface 100. The FIG. 9 embodiment preserves the original cross-sectional dimension of the conductors, whereas in FIG. 8, with the single abrading operation, the conductor cross-sections are reduced in order to assure exposure of surface 100 of shield 84.

Stripping in the form of grinding or abrading is conventional in the formation or terminations of flat cable conductors and can be controlled conventionally to a high degree. Thus, whether a floating or dedicated ground is required, the stripping process is exceptionally simple and does not alter the relative spacing between the shield and its adjacent conductors. This is particularly important because the termination of such a cable does not alter the impedance of the cable due to the protection of the embedded layer which includes the serpentine shield. Thus, not only is cross-talk prevented to a large degree, but the termination procedure results in a uniform termination impedance for the cable.

Manufacturing Processes

(a) The Two Pass Process

Figure 10:
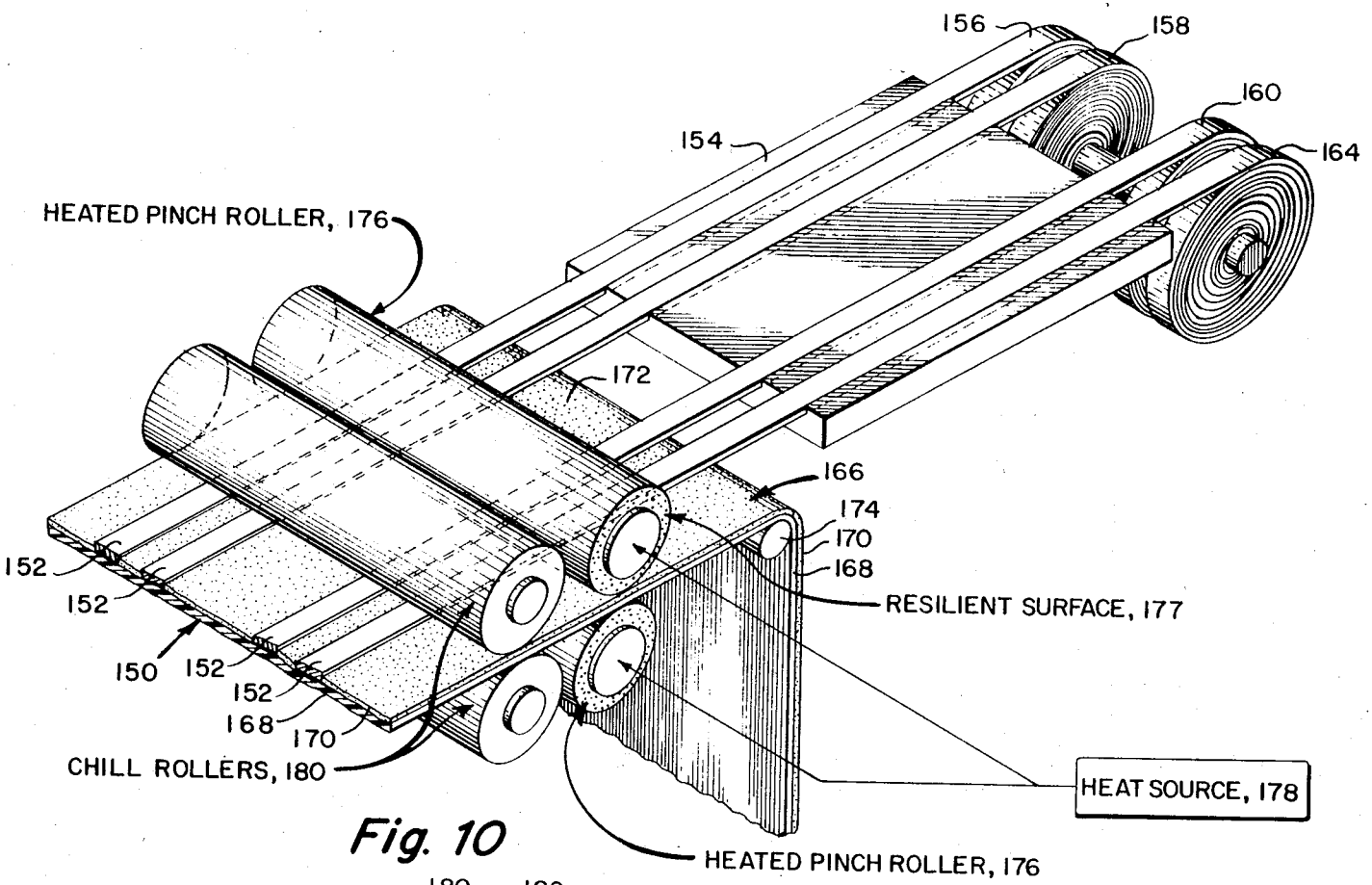
FIG. 10 is a diagrammatic illustration of one method of forming a preformed cable half, which includes the passage of the conductors through a guide and onto a carrier layer coated with a heat activated adhesive.

As mentioned hereinbefore, either a two-pass or a one-pass system can provide for the cables illustrated in FIGS. 1–9. Referring now to FIG. 10 in a two-pass process, a cable half generally illustrated at 150 is formed with conductors 152 thereon through the guiding of these conductors via a wire guide 154 from respective spools 156, 158, 160 and 164 onto a web generally indicated at 166 which forms a carrier for the conductors. In one embodiment, web 166 includes a MYLAR or like carrier 168 over which is coated a heat activated adhesive 170, in one embodiment a polyester layer. Note that when the term "adhesive" is used herein it refers to an electrical nonconductive or dielectric material. Thus, there is no need to provide further insulation between the conductors. Conductors 152 pass through wire guide 154 and onto the top surface 172 of the web which, after passage over idler roller 174, is positioned between the nips of heated pinch rollers 176 which are provided in one embodiment with a resilient surface 177, in one instance rubber. A heat source 178 provides heating for pinch rollers 176 such that the conductors and the adhesive layer 170 is heated above the melting temperature of the layer such that conductors 152 are bonded to the adhesive layer. After emerging from the heated pinch roller nips which are the portions of closest approach of the two parallel oriented rollers, the completed cable half is passed through chill rollers 180 in a conventional manner so as to complete the lamination of conductors 152 by adhesive layer 170 to carrier 168.

Figure 11:
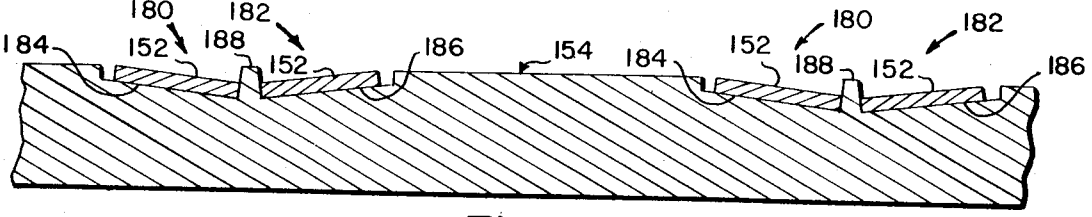
FIG. 11 is a cross-sectional diagram of a portion of the wire guide of FIG. 10 illustrating a wire guide having floor portions which are slanted towards one edge or the other of the guide such that the wires when pulled down through the guide move toward the wire guide edge having the lower portion of the sloped floor adjacent thereto.

Referring to FIG. 11, guide 154 may be provided with slots generally indicated at 180 and 182 which have floor portions 184 and 186 which are slanted downwardly and inwardly towards a separator portion 188 which forms one side of the channel of the wire guide. Upon pulling of the conductors through the wire guide, conductors 152 move towards the central support 188 and are guided thereby such that movement within the guide is minimal, since the conductor inner portions rest against guide 188, regardless of how wide the channel is. This technique in and of itself increases the accuracy of the pitch at which the conductors can be placed on a carrier sheet and is in part responsible for the improved pitch control of the subject invention.

Having formed one cable half, it is then possible to sandwich a shield in between two such halves so as to form the final sandwich which is pinch rolled into the above-mentioned conformal configuration. This process is shown in FIG. 12.

Referring to FIG. 12, rolls 200 and 202 containing the cable halves obtained from the apparatus of FIG. 10 is fed in between two heated pinch rolls 204 and 206. A central web generally indicated at 208 is also fed between rolls 204 and is sandwiched between the cable halves. The central web includes a shield 210, adhesive layers 212 and 216, and dielectric layers 218 and 220 and adhesive layers 222 and 224. Optionally, layers 222 and 224 may be omitted assuming enough adhesive on the confronting surfaces of the cable halves. In either event, the central web is sandwiched between the cable halves coming from spools 200 and 220, all of which are passed through pinch rollers 204 and 206 which are heated above the melting temperature of the heat-activated adhesive. Thereafter, the sandwich is passed through chill rolls 230 and 232 to provide the final cable comprising shield 210 dielectric insulating layers 218 and 220, conductors here shown at 234 and 236 followed by outer layers 238 and 240. This structure is shown in FIG. 13A in an exploded view in which shield 210 is positioned between dielectric layers 218 and 220 which are double coated in one embodiment, with layer 218 being coated with adhesive layers 212 and 222 and with layer 220 being coated with adhesive layers 216 and 224. Outer layer 238 has an internal adhesive layer 242, whereas a bottom layer 240 has an adhesive layer 244. Conductors 234 are as illustrated in between layer 220 and outer layer 238, whereas conductors 236 lie between insulating layer 218 and outer layer 240. Upon the pinch rolling and chilling illustrated in FIG. 12, the conformal structure of FIG. 13B is illustrated in like reference characters which are utilized between like elements, vis-a-vis FIGS. 13A and 13B. Here it can be seen that the adhesive layers have merged with one another and amalgamated during the heating and pressing process.

(b) The One Pass Process

Figure 14:
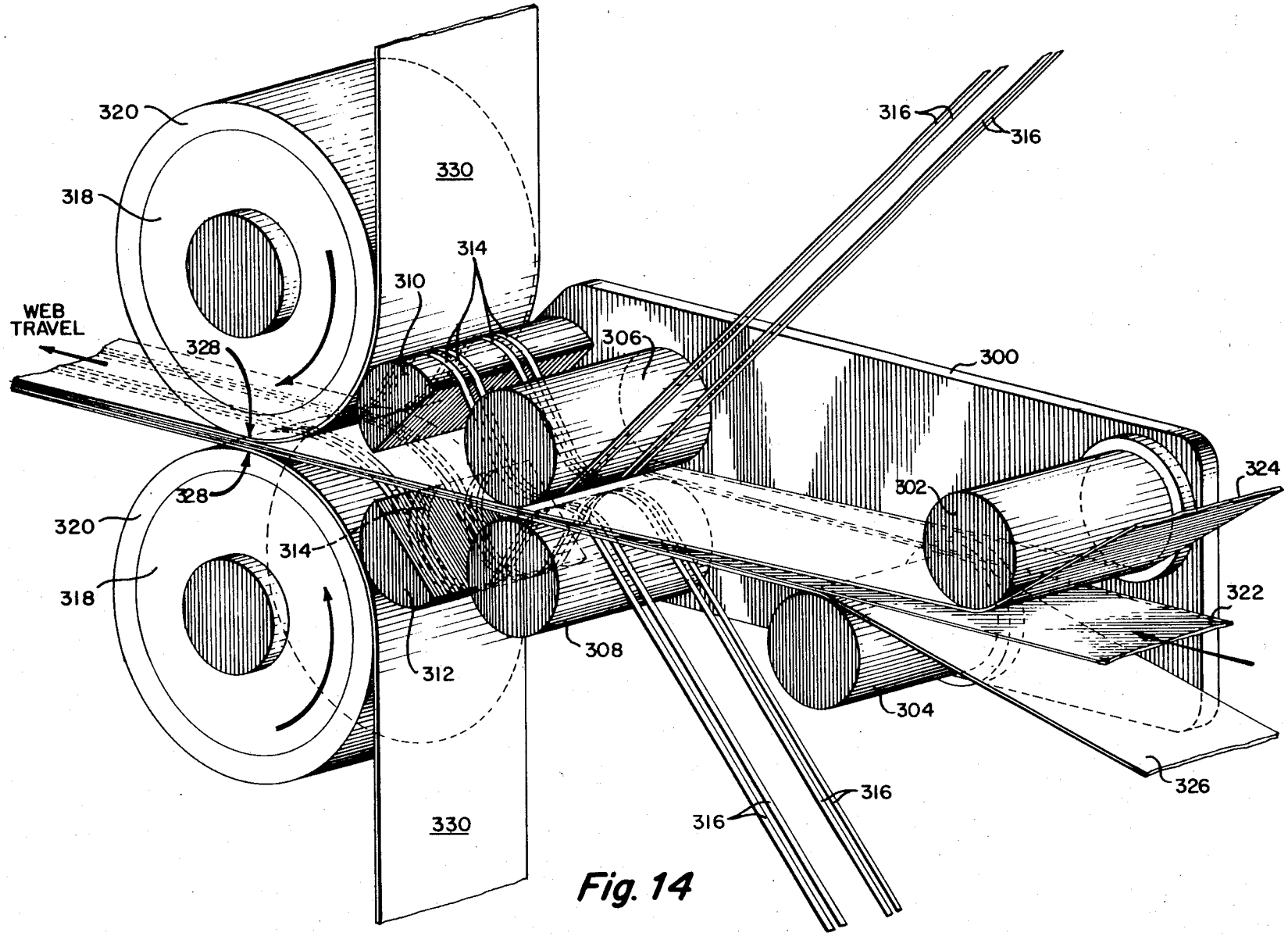
FIG. 14 is a diagrammatic and isometric illustration of one apparatus for simultaneously marrying in one pass all of the parts of the cable illustrated in FIGS. 12, 13A and 13B, also illustrating the cylindrical wire guides and the tangential contact of the conductors to the pinch rollers ahead of the nip.

Referring now to FIG. 14, a one pass process which results in a considerable improvement in pitch tolerance includes apparatus mounted to a plate 300 which includes cylindrical guides 302, 304, 306 and 308 and semi-circumferential cylindrical guides 310 and 312, each having grooves 314 for positioning and guiding conductors 316 towards heated pinch rollers 318 which carry resilient surfaces 320 about their peripheries. In one embodiment, these resilient peripheries are rubber sleeves, although any suitable resilient uniform material may be utilized.

A shield 322 is introduced along the longitudinal centerline of the apparatus along with double adhesive coated carriers 324 and 326, typically Mylar coated on either side with polyester adhesive. Alternatively, only the interior surfaces of carriers 324 and 326 need be coated with a dielectric adhesive assuming enough adhesive on the interior surfaces of the outer covering layers. In any event, these elements which constitute the central web are introduced down through the guides to the nips generally indicated by arrows 328 of the heated pinch rollers. The outer covering layers 330 are introduced from the top and bottom around the pinch rollers so that they over and underlie the central web. As before, the outer covering layers are provided with dielectric heat-activated adhesive on their interior surfaces and are thus single side coated. The conductors are introduced by virtue of their running over cylinders 306 and 308 and over and around semi-circumferential cylinders 310 and 312 with the appropriate grooves therein. The cylinders are fixed or stationary, in one embodiment, but may rotate about their longitudinal axes if desired. As will be discussed in connection with FIG. 15, the conductors contact the single sided adhesive coated outer layers 330 at a point before nip 328 of the pinch rollers so that not only are the conductors constrained by cylindrical surfaces involved but they are also preheated by pinch rollers 318 prior to the time that they are married with the associated sandwich structure at the pinch roller nips. The pinch rolling results in the aforementioned conformal shape in which the shield is pushed between the interdigitated pairs of conductors or single conductors, as the case may be. The dimensional stability of the conductors vis-a-vis the carriers is established by virtue of the aforementioned passage of these conductors around cylindrical surfaces which tend to align up perpendicular to the longitudinal axis of the cylinders.

Figure 15:
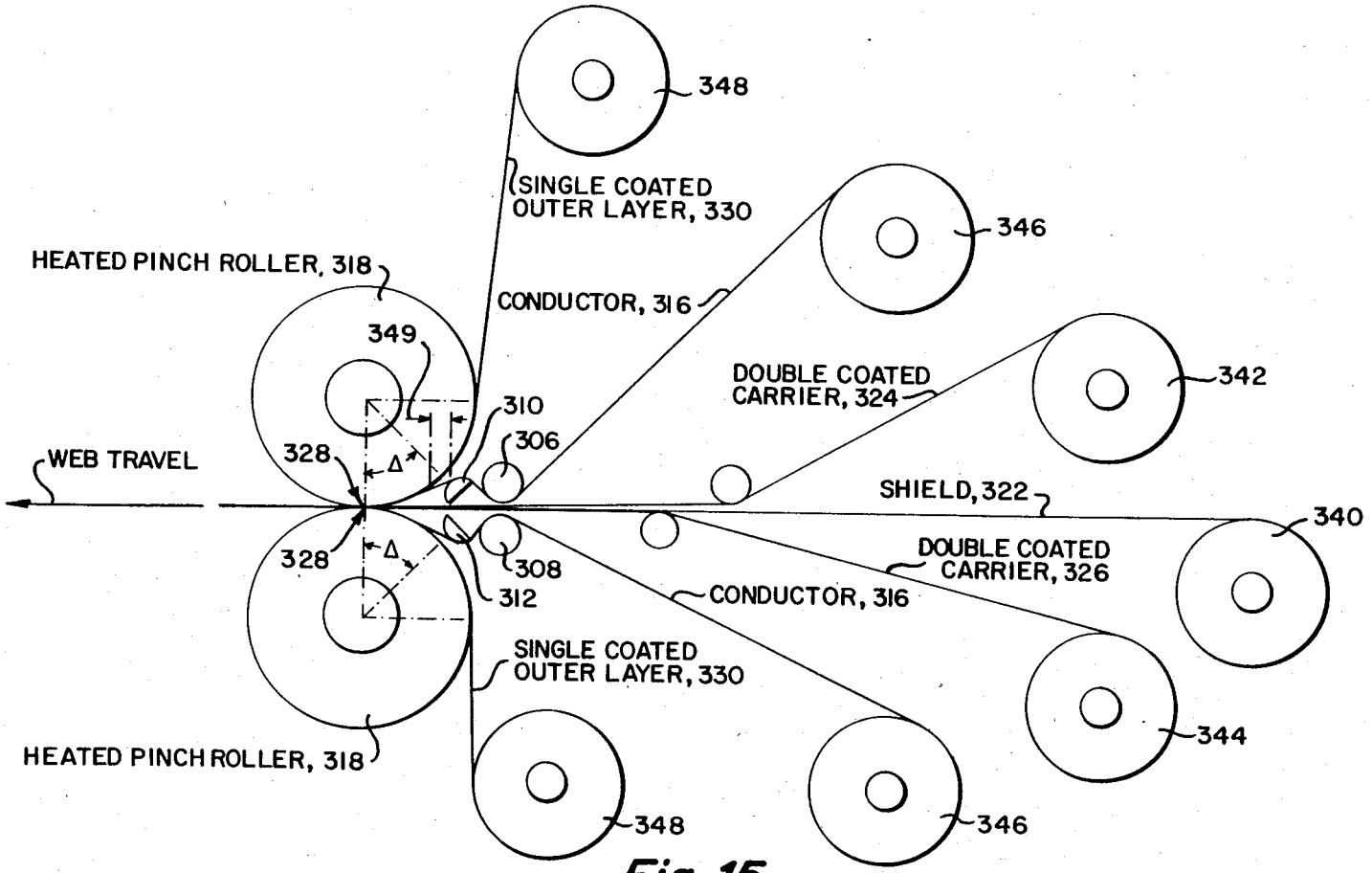
FIG. 15 is a schematic diagram of the operation of the system of FIG. 14.

Referring to FIG. 15, the process carried out in FIG. 14 is diagrammatically illustrated in which shield 322 is threaded between carrier 324 and carrier 326 having been fed from rolls 340, 342 and 344, respectively. Conductors 316 are fed from rolls 346 and 348 and are channeled about cylindrical guides 306 and 308 as well as semi-circumferential guides 310 and 312 such that the conductor impinges tangentially upon the heated pinch roller 318 with a minimum transfer gap illustrated by arrow 349, which can be reduced to zero by close guide-roller spacing. The point of contact of the conductor with the roller is at some distance from nip 328 of each pinch roll. In one embodiment, this point is located 30° ahead of the nip. Thus, the conductor travels about cylindrical surfaces to the point of the marrying of all of the constituent parts of the cable at nip 328. This permits more accurate conductor positioning than heretofore possible which approximates and even exceeds that associated with the aforementioned U.S. Pat. No. 4,381,420. It will also be appreciated that during the sector indicated by angle Δ the conductors are heated prior to their being exposed to the heat of the rollers at nips 328. This preheating of the conductors increases the dimensional stabilization and adherence not only to the single coated outer layer 330 from spools 348 but also to carriers 324 and 326. It will be appreciated that not only are the conductors preheated but the single coated outer layer is also preheated.

Figure 16A:
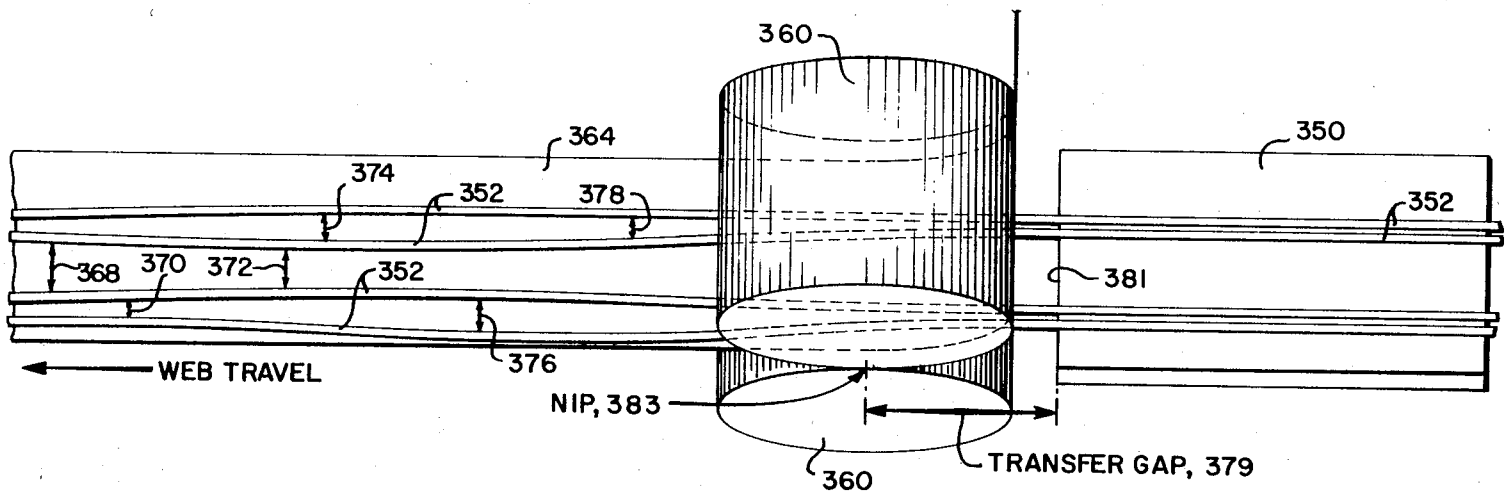
Fig. 16A (PRIOR ART)
FIGS. 16A and 16B are diagrammatic illustrations of the differences in pitch control between the case of conventional flat wire guides and the case of cylindrical wire guides.
Figure 16B:
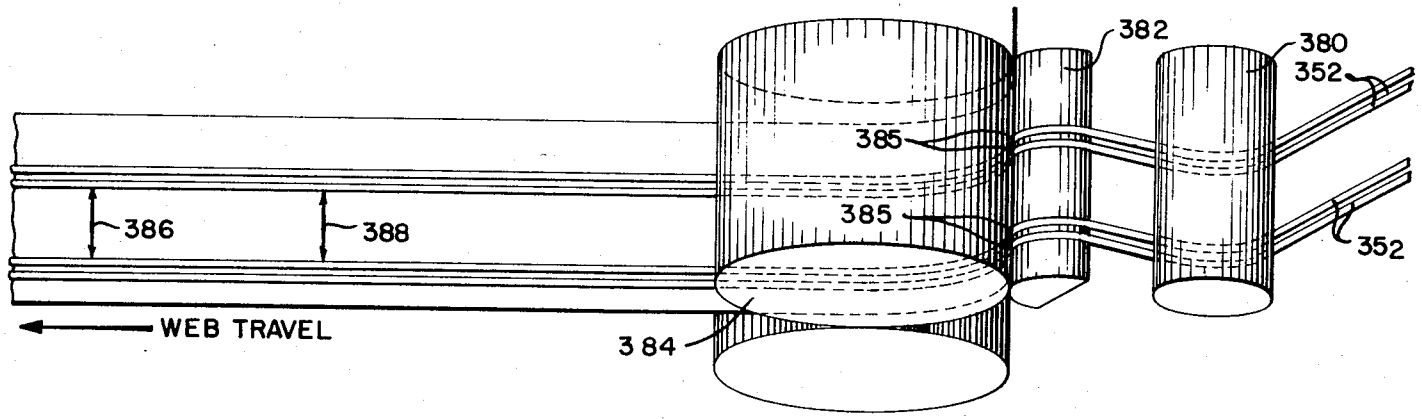

By way of example and referring now to FIG. 16A in the prior art, a conventional guide 350 which guides conductors 352 through pinch rollers 360 results in a swimming of the conductors 352 on web 364 as illustrated by arrows 368, 370, 372, 374, 376 and 378. This is due in part to the transfer gap 379 between the end 381 of guide 350 and nip 383. This gap occurs because the guide, having a finite thickness, cannot be inserted between the pinch rolls. The swimming is also due in part to the movement of the conductors in their respective wire guide channels. Indeed, up to the present time the swimming of conductors on any type of substrate has been an extremely difficult problem to solve. Referring to FIG. 16B, it will be appreciated that conductors 352 are channeled around a cylindrical guide 380, a grooved cylindrical guide 382 and around a portion of a cylindrical pinch roller 384 such that the distance indicated by arrows 386 and 388 indicate very little if any swimming of the conductors after pinch rolling. The pitch tolerance achievable by the utilization of cylindrical surfaces for conductors far exceeds that of straight guides shown in FIG. 16A and accounts for the ±0.002 inch tolerance or better pitch stability when utilizing the subject system. More importantly, pitch tolerance is improved by the reduction in transfer gap here illustrated to be almost zero at points 385, the tangency point. Thus, the problem of conductor movement due to the traditional transfer gap is eliminated or at least minimized through use of minimal transfer gaps.

Regardless of whether a flat cable has an internal shield, it will be appreciated that the rollers each having resilient surfaces and being of identical and uniform shape contributes to the symmetry of the cable as well as the maintainance of pitch such that either singly or in combination the wire guiding, dwell time, and soft rolling technique produces significantly improved pitch control over that available in the prior art.

In summary, in one embodiment, conductor positioning for the prelaminated conductors is maintained to an extremely high tolerance through the utilization of a wire guide having a floor portion which is slanted towards one edge or the other of the guide such that when the conductors are pulled downwardly through the guide, they move toward the wire guide edge having the lower portion of the sloped floor adjacent thereto.

Another way of maintaining the tolerances described above is through the use of cylindrical guides with circumferential grooves. The accuracy of conductor positioning is achieved by running the conductors over the cylindrical groove. The cylindrical guides are located adjacent the associated pinch roller such that the wire contacts the pinch roller prior to the nip and proceeds with it until it reaches the nip. This preheats the wires and preserves the conductor spacing which prevents conductor "swimming." Thus pulling the conductors over at least two cylindrical surfaces, the cylindrical wire guide surface and the pinch roller surface, conductor positioning and pitch is uniquely controlled.

(c) Alternative Manufacturing Processes

Figure 17:
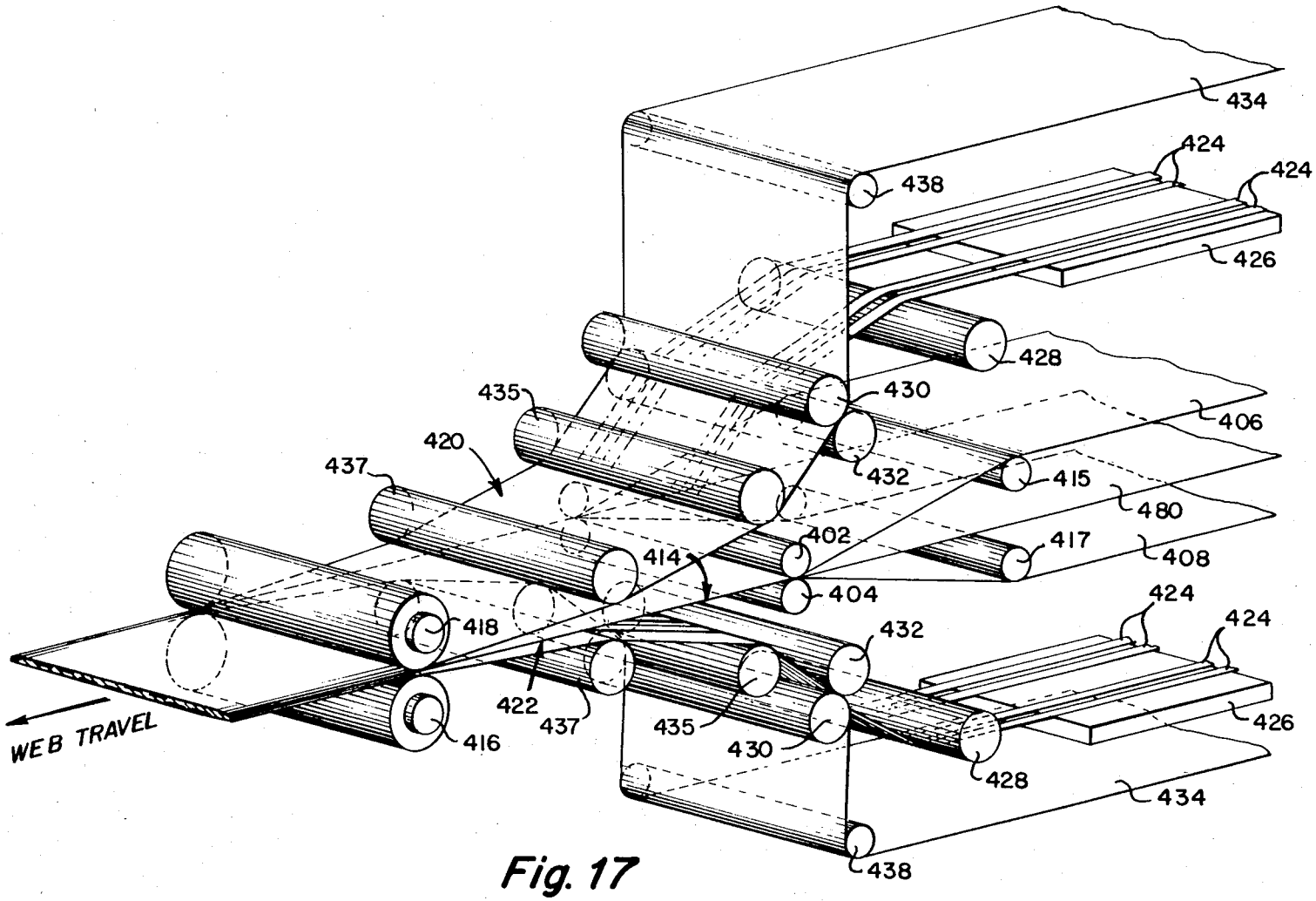
FIG. 17 is a diagrammatic illustration of alternative apparatus for carrying out the process shown in connection with FIGS. 10 and 12, in which a carrier supporting the conductors is first formed, followed by marrying this structure to either side of a central structure carrying the embedded shield.

Referring now to FIG. 17, an alternative method of forming the subject cable includes a process by which a shield 400 is guided towards heated pinch rollers 402 and 404 having either single or double coated carriers 406 and 408 of the type described to either side thereof to form a central web 414. Carriers 406 and 408 pass over cylindrical guides 415 and 417. This central web is passed to pinch rollers 416 and 418 which are heated and to which is fed the aforementioned cable halves 420 and 422. These halves are directed towards the nips of pinch rollers 418 and 416 over cylindrical guides 424 and 426, respectively. In each case, conductors 424 are fed through a conventional guide 426 or one configured in accordance with the teachings of FIG. 11. The conductors from the guide run over a cylindrical guide 428 where they are married at heated pinch rollers 430 and 432 to a carrier 434 which has a single sided adhesive layer thereon. The conductor-carrying layer 434 is guided over cylindrical guides 435 and 437 to the nips of heated pinch rollers 416 and 418 to complete the fabrication of the aforementioned conformal shielded cable. It will be appreciated that outer layer 434 is also guided by a cylindrical guide 438 so that it may be properly married with the conductors.

In this manner, the two halves of the cable are first made up via heated pinch rollers 430 and 432 whereas the central web is first made up via processing through heated pinch rollers 402 and 404.

It will be appreciated that four pairs of heated pinch rollers are required for the FIG. 7 embodiment, two each for the marrying of the conductors to the outer layer, one for the marrying of the insulating layers to the shield and one final pair for the marrying of all of the results of the above together.

Figure 18:
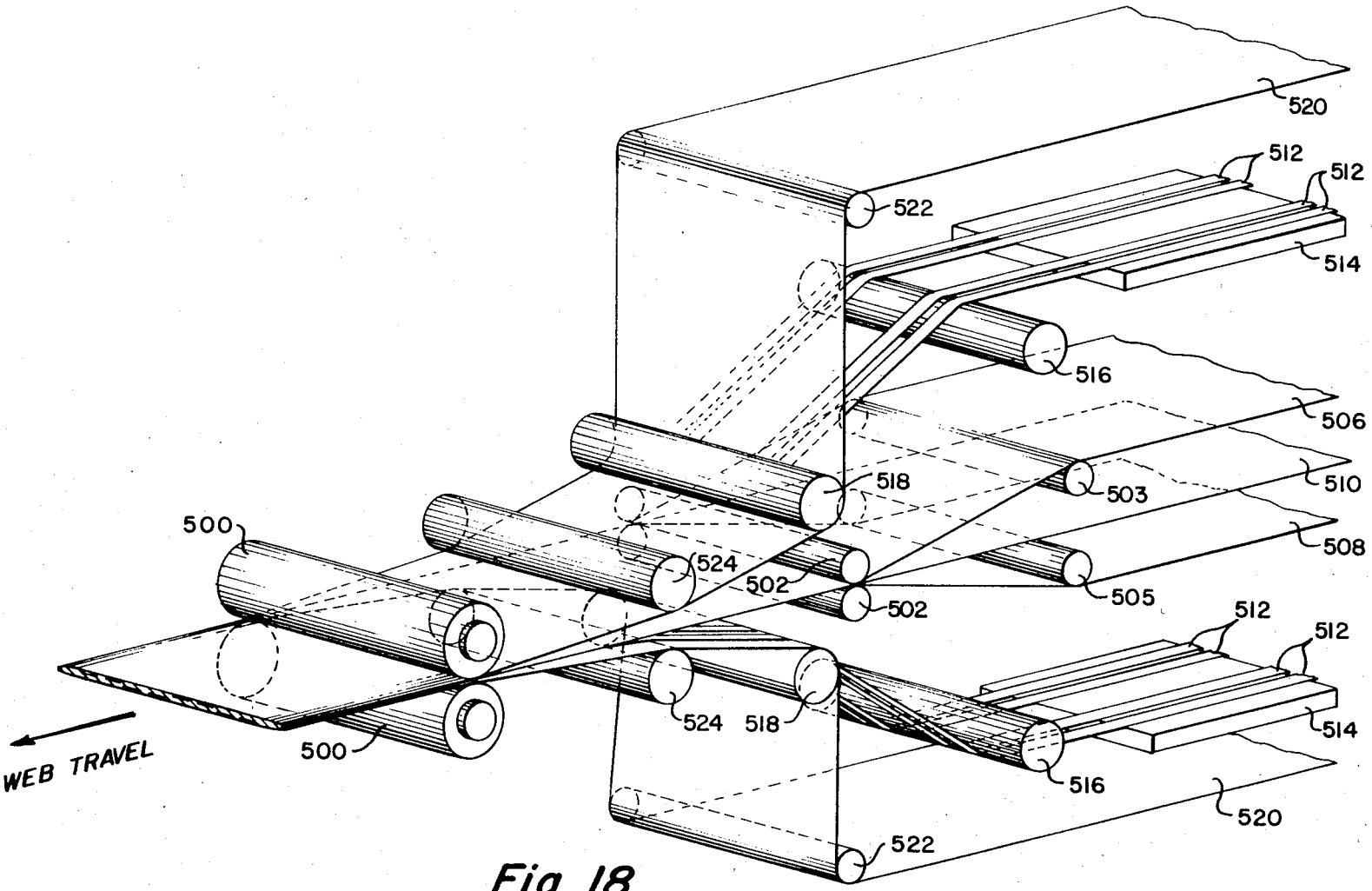
FIG. 18 is a diagrammatic illustration of the formation of the subject multiconductor cable through the utilization of a single pair of heated pinch rollers, in which the conductors are made to adhere to their respective carriers at the same time that the conductor carrying carriers are sandwiched about a central structure containing the embedded shield.

Referring to FIG. 18, only one heated pair of pinch rollers 500 is utilized in providing the final sheet, with rollers 502 and 504 merely providing guides for single or double-coated insulating layers 506 and 508 and shield 510 to the nip between heated pinch rollers 500. In this embodiment, conductors 512 are guided by a wire guide 514 over cylindrical guide 516 and over a guide 518 which is also utilized to guide outer layer 520 to the nip of rollers 500. Cylindrical guides 522 and 524 serve the same purpose as the corresponding guides in the aforementioned embodiment of FIG. 17, with the difference being that the lamination does not take place until passage through the heated pinch rollers 500.

What will be appreciated is that there are a number of ways of forming the conformal multilayer shielded cable of FIGS. 1–6, with the result that the embedded shield provides increased cross-talk protection by semi-circumferentially surrounding adjacent pairs of conductors or adjacent single conductors. Termination is made exceedingly simple which involves a grinding operation which does not alter the relative distances between the conductors and the shield therefore eliminating termination impedance problems during termination of the cable. The cable may be utilized either with or without an external shield depending upon the amount of EMI protection required and is both flexible and thin having a maximum conductor count per unit width to provide the aforementioned cross-talk protection.

Having above indicated a preferred embodiment of the present invention, it will occur to those skilled in the art that modifications and alternatives can be practiced within the spirit of the invention. It is accordingly intended to define the scope of the invention only as indicated in the following claims.

What is claimed is:

1. A flat embedded shield multiconductor signal transmission cable having elements including at least two adjacent conductors laterally spaced apart and occupying different planes, said cable including a sheet-like shield of electrically conductive material running between said adjacent conductors across at least a portion of the width of said cable, said conductors positioned to either side of said shield in different planes and in a laterally offset fashion, said cable having an outer skin and means for insulating said conductors one from the other and from said shield, whereby cross-talk between said adjacent conductors is substantially reduced.

2. The cable of claim 1 wherein said shield runs in a serpentine path between said conductors so as to semi-circumferentially surround said conductors.

3. The cable of claim 1 wherein each of said adjacent conductors is one conductor of a pair of conductors.

4. The cable of claim 1 and further including means for grounding said shield.

5. The cable of claim 4 wherein said grounding means includes an auxiliary conductor running longitudinally of said cable and being electrically connected to said shield, said insulating means insulating said auxiliary conductor from said other conductors.

6. The cable of claim 1 wherein said shield material is nonmagnetic.

7. The cable of claim 1 wherein said shield material is magnetic.

8. The cable of claim 1 wherein said shield is in the form of a solid sheet.

9. The cable of claim 1 wherein said shield is woven.

10. The cable of claim 1 wherein said shield is in the form of a sheet having apertures therein.

11. The cable of claim 1 wherein the elements of said cable are laminated together with a dielectric adhesive.

12. The cable of claim 11 wherein said shield has insulation on both sides thereof and wherein said adjacent conductors are positioned in spatial planes to provide at least interdigitated conductors, with said shield arranged in a serpentine path around said conductors to provide a semi-circumferential shielding about said conductors.

13. The cable of claim 1 wherein said insulation for said shield includes sheets of insulating material to either side of said shield.

14. The cable of claim 13 wherein said insulating material is Mylar.

15. The cable of claim 1 wherein said skin includes two sheets of insulating material.

16. The cable of claim 1 and further including an electrically conductive outer shield on the top and on the bottom surfaces of said cable.

17. The cable of claim 16 wherein said outer shield is adhered to said skin.

* * * * *